US010867767B2

(12) United States Patent
Lathrop et al.

(10) Patent No.: US 10,867,767 B2
(45) Date of Patent: Dec. 15, 2020

(54) FIELD-CONFIGURABLE INTERRUPTION APPARATUS HAVING INDIVIDUALLY SELECTABLE INTERRUPTION PORTION AND ELECTRONIC PORTION

(71) Applicant: Eaton Intelligent Power Limited, Dublin (IE)

(72) Inventors: Todd Matthew Lathrop, Oakdale, PA (US); Jeffrey Wayne Lockhart, Pittsburgh, PA (US); Andrew Robert Zahn, Dedham, MA (US); Lanson Dwight Relyea, Moon Township, PA (US); Jay Nicholson Haugen, Pittsburgh, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/987,857

(22) Filed: Aug. 7, 2020

(65) Prior Publication Data

US 2020/0365359 A1 Nov. 19, 2020

Related U.S. Application Data

(63) Continuation of application No. 14/886,173, filed on Oct. 19, 2015, now abandoned.

(51) Int. Cl.
*H01H 89/00* (2006.01)
*H01H 9/02* (2006.01)

(52) U.S. Cl.
CPC ..... *H01H 89/00* (2013.01); *H01H 9/02* (2013.01)

(58) Field of Classification Search
CPC ..... H01H 9/02; H01H 9/0271; H01H 89/00; H01H 89/06; H01H 89/08; H02B 1/308
See application file for complete search history.

(56) References Cited

U.S. PATENT DOCUMENTS

| | | | | |
|---|---|---|---|---|
| 4,641,216 | A | 2/1987 | Morris | |
| 4,667,263 | A | 5/1987 | Morris | |
| 4,686,600 | A | 8/1987 | Morris | |
| 4,752,660 | A * | 6/1988 | Yokoyama | H01H 9/32 218/117 |
| 5,652,420 | A | 7/1997 | Innes | |
| 6,215,378 | B1 * | 4/2001 | Gibson | H01H 83/04 335/18 |
| 2001/0022264 | A1 * | 9/2001 | Merlin | H01H 89/06 200/50.32 |
| 2003/0178292 | A1 | 9/2003 | Gerard | |
| 2007/0121268 | A1 * | 5/2007 | Terhorst | H01H 83/04 361/115 |

(Continued)

*Primary Examiner* — Jacob R Crum
(74) *Attorney, Agent, or Firm* — Eckert Seamans Cherin & Mellott, LLC

(57) ABSTRACT

An interruption apparatus includes a first portion having a trip unit and a second portion having a detection system. The first and second portions are individually selectable based upon the particular application and are then movable from a detached configuration to a connected configuration. The first and second portions are selected from a plurality of first portions and second portions having different specifications. A desired first portion having a first interruption rating and a desired second portion having detection capabilities that are suited to the particular application can be assembled together to provide a field-configurable interruption apparatus.

20 Claims, 4 Drawing Sheets

(56) References Cited

U.S. PATENT DOCUMENTS

| | | | | |
|---|---|---|---|---|
| 2010/0296216 | A1* | 11/2010 | Schweitzer ..... | H01H 71/025<br>361/87 |
| 2014/0126158 | A1 | 5/2014 | Baran | |
| 2015/0068881 | A1 | 3/2015 | Watford | |
| 2015/0123751 | A1 | 5/2015 | Lee | |

* cited by examiner

FIELD-CONFIGURABLE INTERRUPTION APPARATUS HAVING INDIVIDUALLY SELECTABLE INTERRUPTION PORTION AND ELECTRONIC PORTION

CROSS REFERENCE TO RELATED APPLICATION

This application is a continuation application of and claims priority to U.S. patent application Ser. No. 14/886,173, filed Oct. 19, 2015, the disclosures of which are incorporated herein by reference.

BACKGROUND

Field

The disclosed and claimed concept relates generally to electrical interruption equipment and, more particularly, to a field-configurable interruption apparatus.

Related Art

Numerous types of electrical interruption equipment are well understood in the relevant art. Among the types of electrical interruption equipment are circuit interrupters such as circuit breakers and the like. Numerous types of circuit interrupters have various interruption ratings and have various features such as fault detection capabilities and the like that are known in the relevant art.

Certain applications, such as in circuit breaker panels that are used in the home and in other applications, a wide variety of circuit breakers having various interruption ratings and various other features can be provided within the same circuit breaker panel, and this is because the various circuit breakers are selected for use with the different types of loads and conditions that may be present. For example, certain circuit breakers may have a relatively lower interruption rating, say, fifteen Amperes, when use for operating electric lights and the like. Other circuit breakers may have other ratings, such as thirty Amperes, when the circuit is intended to operate a clothes dryer or other high load application.

Moreover, circuit breakers at a given interruption rating may have various interruption features that are selected based upon the needs of the particular application. For example, a very basic circuit interrupter may employ a thermal trip or a magnetic trip or a combination thermal/magnetic trip that is configured to operate a trip units and separate a set of separable contacts in certain overcurrent conditions and other conditions. It may be desirable to additionally provide a ground fault detection and tripping capability in the circuit breaker if the load is situated in a moist or potentially wet environment or in other situations. Additionally or alternatively, it may be desirable to provide some type of arc fault detection and tripping capability that may detect branch arc faults (which are parallel with a load). A circuit breaker may additionally provide arc fault detection and tripping capability that may detect an arc fault in series with a load (in which case the parallel and series fault protection may be referred to as combination arc fault protection).

It thus can be seen that a wide array of combinations of interruption ratings and features are possible in any such circuit breaker. It thus can also be understood that a contractor typically will be required to carry a wide variety of circuit breakers in order to provide the variety of circuit breakers having specific interruption capabilities and specific detection properties to suit the various applications that the contractor may encounter on a daily basis. Maintaining such an inventory and carrying such an inventory from place to place can be cumbersome. Improvements thus would be desirable.

SUMMARY

Accordingly, an improved interruption apparatus meets these and other needs. The improved interruption apparatus includes a first portion having a trip unit and a second portion having a detection system. The first and second portions are individually selectable based upon the particular application and are then movable from a detached configuration to a connected configuration. The first and second portions are selected from a plurality of first portions and second portions having different specifications. A desired first portion having a first interruption rating and a desired second portion having detection capabilities that are suited to the particular application can be assembled together to provide a field-configurable interruption apparatus.

Accordingly, an aspect of the disclosed and claimed concept is to provide an interruption apparatus that is field-configurable to have particular capabilities and properties that are suited to specific applications.

Another aspect of the disclosed and claimed concept is to provide an interruption apparatus having a first portion that is selected from a plurality of first portions having different specifications and a second portion that is selected from a plurality of second portions having different specifications, with the selected first portion and the selected second portion being connectable together to provide a field-configured interruption apparatus having specifications that are suited to a specific application.

Another aspect of the disclosed and claimed concept is to provide an improved interruption apparatus having a first portion that includes a trip unit and a second portion that includes at least a conductor and that may additionally include a fault detection system, with the first and second portions initially being in a detached configuration, and with the first and second portions then being movable to a connected configuration from which the first and second portions are inseparable and which results in the interruption apparatus having a combination of features that comprise the various features of the first portion and the various features of the second portion.

Accordingly, an aspect of the disclosed and claimed concept is to provide an improved interruption apparatus structured to be electrically connected with a line conductor and a load conductor of an electrical circuit and to switch at least a portion of the circuit between an ON condition and an OFF condition. The interruption apparatus can be generally stated as including a first portion and a second portion. The first portion can be generally stated as including a first housing, a first electrical apparatus situated on the first housing and which can be generally stated as including a set of separable electrical contacts and a first conductor, the first conductor being electrically connected with the set of separable electrical contacts and can be generally stated as including a first connection element that is structured to be electrically connected with one of the line conductor and the load conductor, and a trip unit situated on the first housing, the trip unit being operatively connected with the set of separable electrical contacts and structured to switch the set of separable electrical contacts between an OPEN state and a CLOSED state. The second portion can be generally stated as including a second housing and a second electrical apparatus situated on the second housing, the second electrical apparatus can be generally stated as including a second conductor having a second connection element that is structured to be electrically connected with the other of the line conductor and the load conductor. The first portion and the second portion are movable from a detached configuration to a connected configuration, the first and second portions being physically and electrically disconnected from one another in the detached configuration, the first and second housings being affixed together and the first and second electrical apparatuses being electrically connected together in the connected configuration.

BRIEF DESCRIPTION OF THE DRAWINGS

A further understanding of the disclosed and claimed concept can be gained from the following Description when read in conjunction with the accompanying drawings in which.

Similar numerals refer to similar parts throughout the specification.

DESCRIPTION

Figure 1:
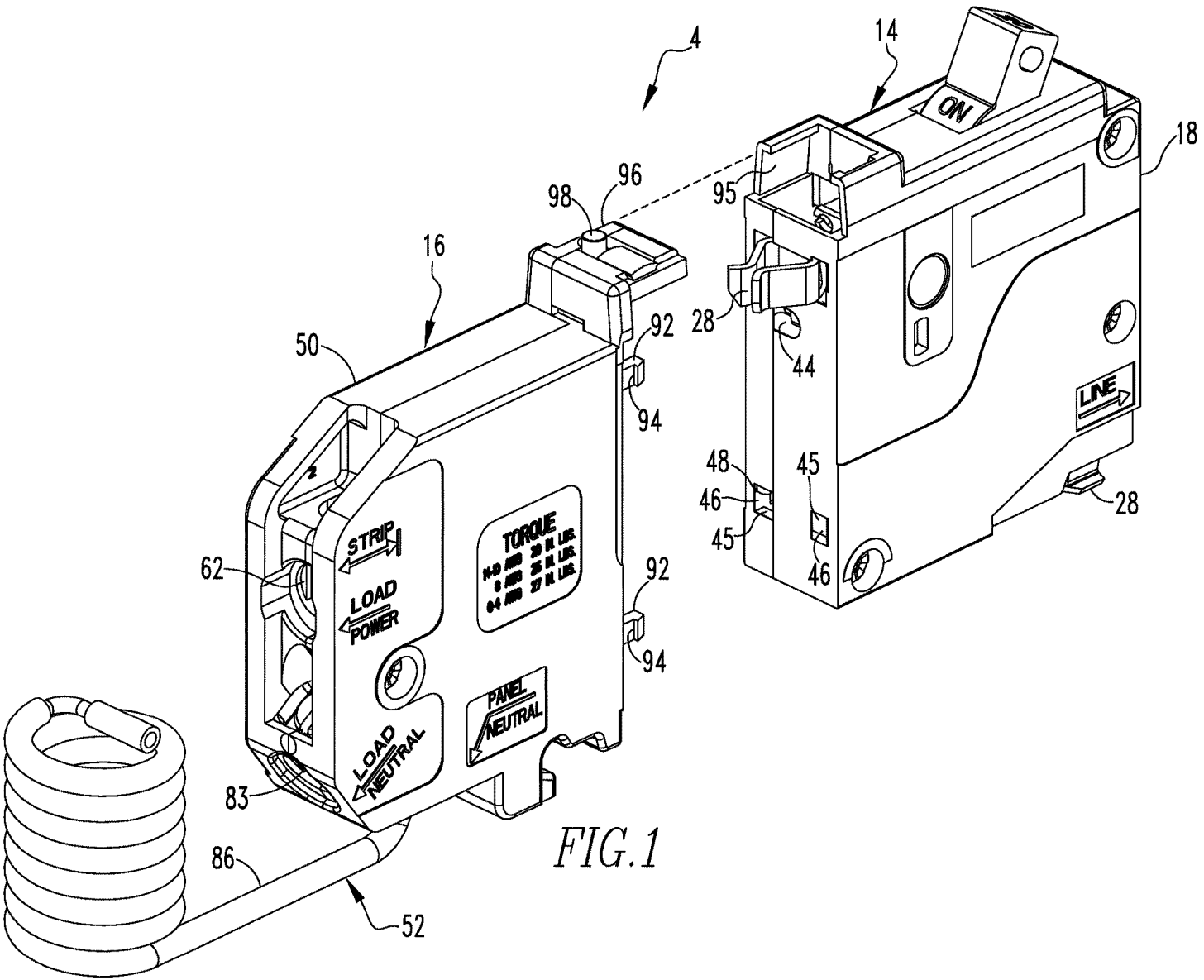
FIG. 1 is a perspective view of an improved interruption apparatus in accordance with the disclosed and claimed concept in a detached configuration.
Figure 3:
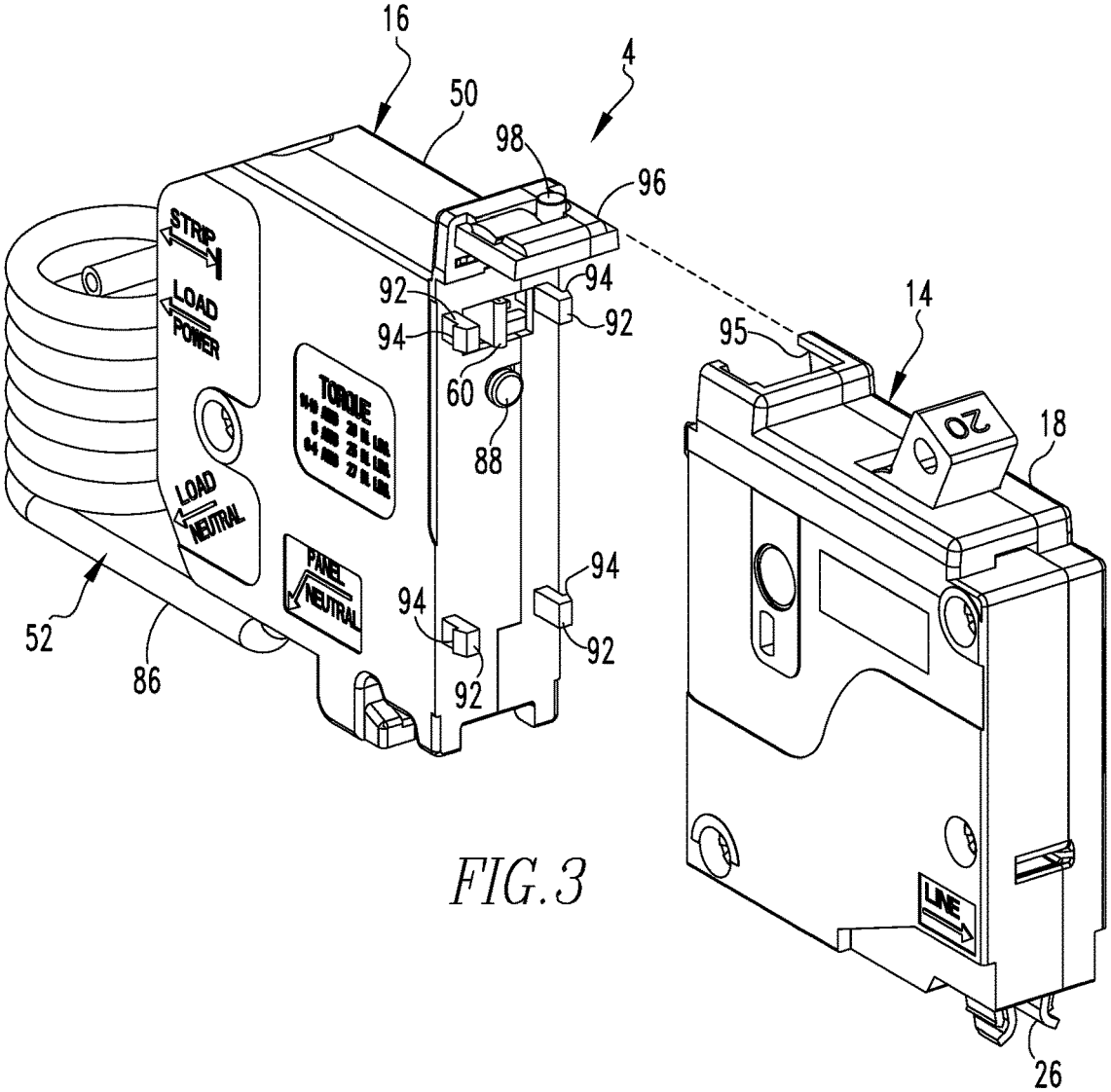
FIG. 3 is another perspective view of the interruption apparatus of FIG. 1 in the detached configuration.
Figure 4:
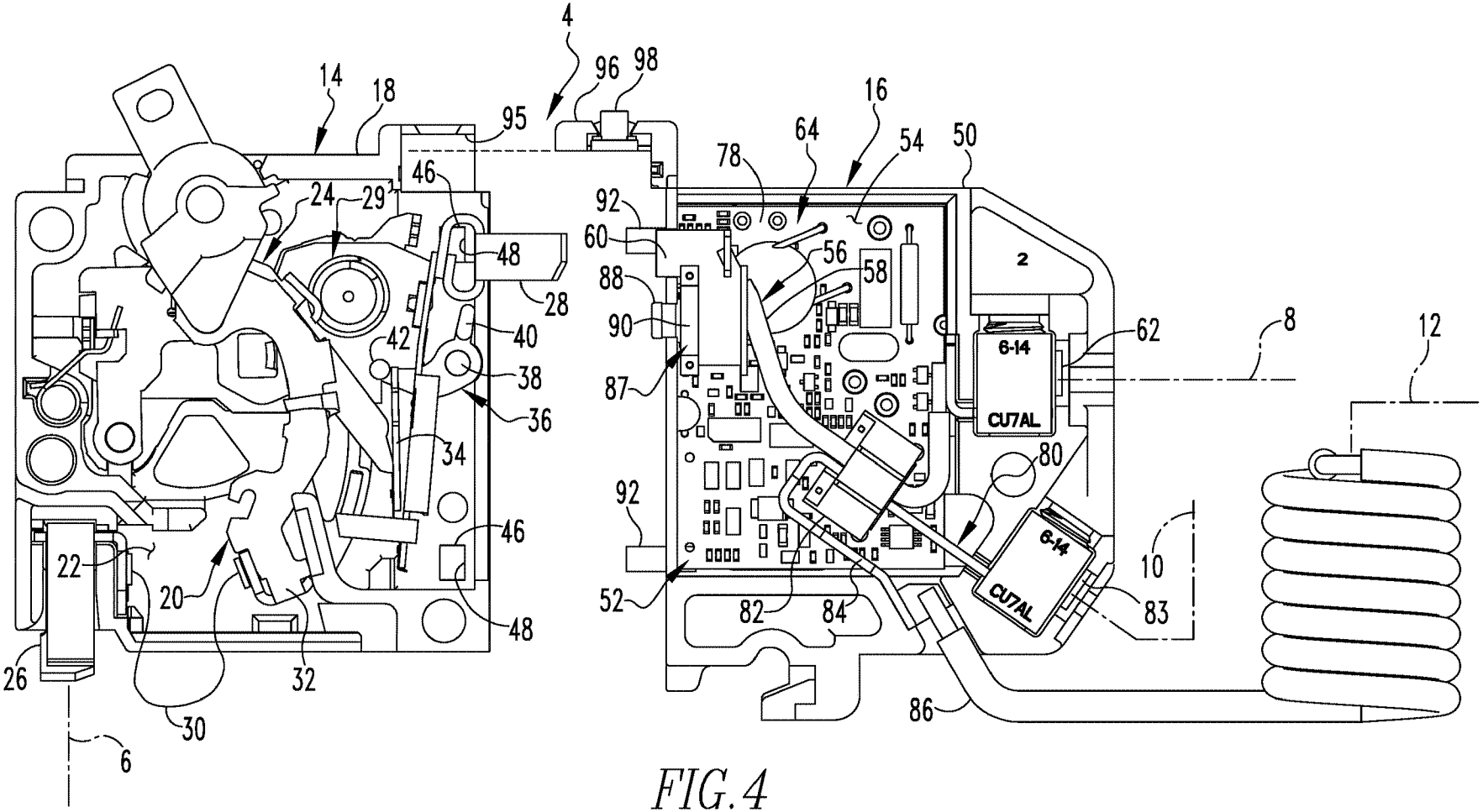
FIG. 4 is a cut away front elevational view of the interruption apparatus of FIG. 1 in the detached configuration.

An improved interruption apparatus 4 in accordance with the disclosed and claimed concept is depicted in FIGS. 1 and 3-4 in a detached configuration. As will be set forth in greater detail below, the interruption apparatus 4 is field configurable from separate components that are movable from the detached configuration, such as is depicted generally in FIGS. 1 and 3-4, to a connected configuration, such as is depicted in FIGS. 5 and 6, in order to enable components having desired specifications to be combinable to form the interruption apparatus 4 which has a combined set of specifications that are suited to particular applications.

As is depicted in a schematic fashion in FIG. 4, the interruption apparatus 4, when ultimately placed in the connected configuration, is connectable with a line conductor 6 and a load conductor 8 and is suited to provide an electrical interruption capability to a circuit that includes the line and load conductors 6 and 8. The exemplary interruption apparatus 4 that is depicted in FIGS. 1-6 is further connectable with a load neutral conductor 10 and a pigtail neutral conductor 12 since, as set forth below, the exemplary interruption apparatus 4 includes a ground fault detection capability. Other embodiments of the interruption apparatus may be configured to omit a ground fault detection capability without departing from the present concept.

Figure 5:
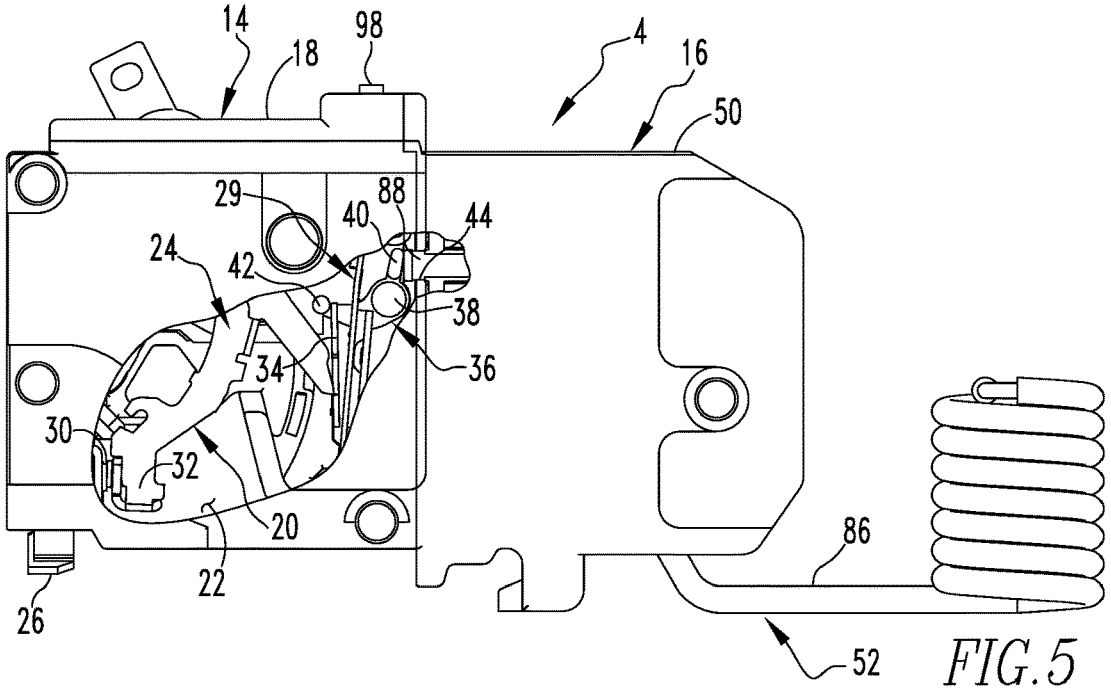
FIG. 5 is a front elevational view of the interruption apparatus of FIG. 1 in a connected configuration, partially cut away, and in an ON condition.
Figure 6:
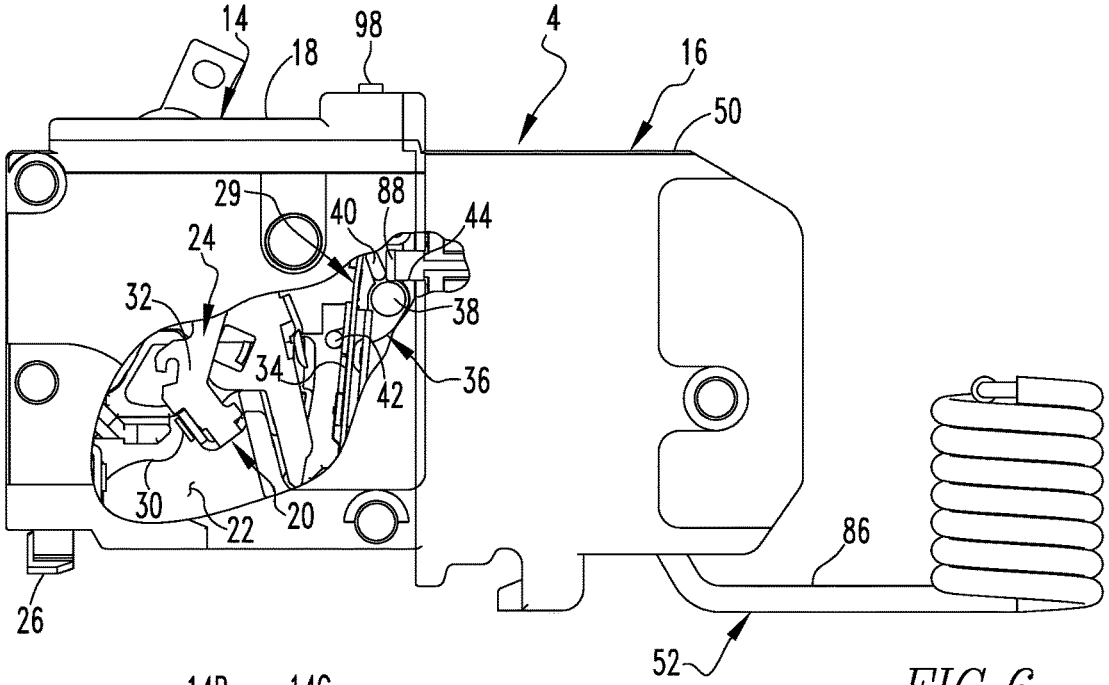
FIG. 6 is a view similar to FIG. 5, except depicting the interruption apparatus in an OFF condition.

As can be understood from FIG. 1, the interruption apparatus 4 can be said to include a first portion 14 and a second portion 16 that are movable from a detached configuration, such as is depicted in FIGS. 1 and 3-4, to a connected configuration, such as is depicted in FIGS. 5-6, which makes the interruption apparatus 4 field-configurable. That is, the first portion 14 is selected from a plurality of first portions 14 having different specifications, and the second portion 16 is likewise selected from a plurality of second portions 16 having different specifications. When the first and second portions 14 and 16 are moved from the detached configuration to the connected configuration, from which the first and second portions are immovable, the resultant interruption apparatus 4 has a combined set of specifications that result from the specifications of the first portion 14 combined the specifications of the second portion 16.

In the depicted exemplary embodiment the first portion 14 is configured to switch the interruption apparatus 4 between an ON condition and an OFF condition, and the exemplary second portion 16 has fault detection capabilities and is usable to trigger the first portion 14 to move from the ON condition to the OFF condition responsive to a detected fault or other condition. The first portion 14 is selected to have a particular current interruption rating from a plurality of different current interruption ratings. The second portion 16 is selected to have certain fault detection or other capabilities from among various possible combinations of capabilities. The interruption apparatus 4 is field configured to have desired specifications merely by selecting and combining separate components to form the interruption apparatus 4.

The first portion 14 can be said to include a first housing 18 and a first electrical apparatus 20. The first housing 18 includes a number of walls formed from a moldable insulative material and is configured to include a first interior region 22 within which the first electrical apparatus 20 is enclosed. As employed herein, the expression "a number of" and variations thereof shall refer to broadly to any non-zero quantity, including a quantity of one.

The first electrical apparatus 20 includes trip unit 24 and further includes a line terminal 26 that is a connection element which is connectable with the line conductor 6. The first electrical apparatus 20 further includes a connector 28 that is electrically connected with the line terminal 26 when the interruption apparatus is in the ON condition, and will be set forth in greater detail below.

The first electrical apparatus 20 further includes a set of separable contacts 30 and a movable contact arm 32 that are depicted generally in FIGS. 4-6. The set of separable contacts 30 includes a movable contact of is situated at a free end of the contact arm 32 and further includes a stationary contact that is electrically connected with the line terminal 26. The trip unit 24 is configured to move the contact arm 32 and to thus move the set of separable contacts 30 between a CLOSED state such as is depicted generally in FIG. 5 and an OPEN state such as is depicted generally in FIG. 6. When the set of separable contacts 30 are in the CLOSED state of FIG. 5, the line terminal 26 and the connector 28 are electrically connected together. In this regard, the contact arm 32 is part of a conductor that can be said to conductively extend between the line terminal 26 and the connector 28 when the set of separable contacts 30 are in the CLOSED state.

The trip unit 24 includes a thermal and magnetic trip 34 that combines both thermal and magnetic trip functions into a bimetal strip that is connected with a latch of the trip unit 24. In certain overcurrent conditions and/or other conditions, the thermal and magnetic trip 34 is movable from the position depicted generally in FIG. 5 to cause the trip unit 24 to release a spring-energized mechanism to cause the contact arm 32 to pivot and move the set of separable contacts 30 from the CLOSED state to the OPEN state. Such movement from the CLOSED state to the OPEN state moves the interruption apparatus 4 from the ON condition to the OFF condition. The first portion 14 further comprises a frame assembly 29 that holds the thermal and magnetic trip in position.

The trip unit 24 further includes a connection crank 36 that is pivotably situated on a support 38 that is disposed on the first housing 18. The connection crank 36 includes a receiver leg 40 and a trigger leg 42 that are situated on opposite ends of the connection crank 36. The receiver leg 40 is situated adjacent a receptacle 44 (FIG. 1) that is formed in the first housing 18, and the trigger leg 42 is situated in proximity to the thermal and magnetic trip 34. The operation of the connection crank 36 will be described in greater detail below.

As is depicted in FIGS. 1 and 4, the first housing 18 has formed therein a plurality of openings 45 that each open onto a retainer structure 46 having a retention surface 48 that is situated in the first interior region 22. As will be set forth in greater detail below, the retainers 46 and the retention surfaces 48 are operable to enable the first and second portions 14 and 16 to be irremovably physically affixed to one another in the connected configuration.

The second portion 16 can be said to have a second housing 50 and a second electrical apparatus 52. The second housing 50 includes a number of wall that are formed from a molded insulative material and has a second interior region 54 within which the second electrical apparatus 52 is enclosed. As will be set forth in greater detail below, the second housing 50 and the first housing 18 are physically connectable to irremovably affix the first and second portions 14 and 16 together.

As is best depicted in FIG. 4, the second electrical apparatus 52 can be said to include an electrically conductive conductor apparatus 56 that includes an electrical conductor 58, a stab 60, and a load terminal 62, with the conductor 58 electrically extending between the stab 60 and the load terminal 62. The stab 60 is electrically connectable with the connector 28 in the connected configuration of the interruption apparatus 4. The load terminal 62 is a connection element that is electrically connectable with the load conductor 8 in the connected configuration of the interruption apparatus 4. The conductor apparatus 56 thus completes the circuit in the connected configuration of the interruption apparatus 4 between the line terminal 26 and the load terminal 62 when the set of separable contacts 30 are in the CLOSED state.

Figure 2:
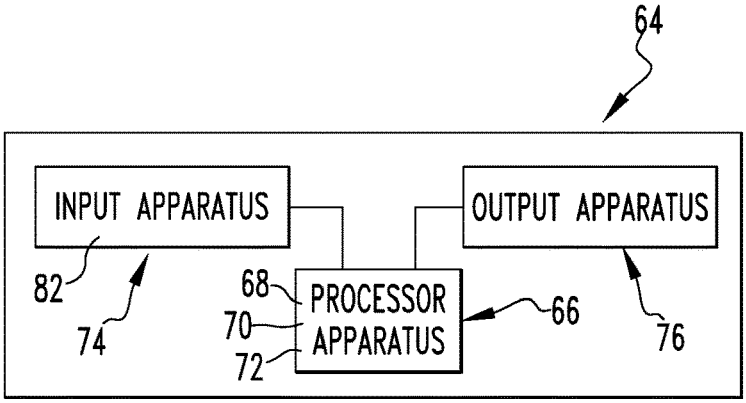
FIG. 2 is a schematic depiction of a portion of the interruption apparatus of FIG. 1.

In the depicted exemplary embodiment, the second electrical apparatus 52 additionally includes a detection system 64 that is depicted schematically in FIG. 2 and that provides a number of fault detection features. It is understood, however, that other embodiments of the second portion 16 may include the conductor apparatus 56 without additionally including the detection system 64 without departing from the present concept.

The depicted exemplary detection system 64 includes a processor apparatus 66 having a processor 68 and a memory 70 having stored therein a number of routines 72. The processor 68 can be any of a wide variety of processors, such as microprocessors and the like, without limitation. The memory 70 can be any of a wide variety of storage devices such as RAM, ROM, EPROM, FLASH, and the like without limitation, and the memory 70 operates in the fashion of an internal storage area of a computer. The routines 72 include instructions and the like in a non-transitory machine readable configuration that are variously storable in the memory 70 and are executable on the processor 68 to cause the processor apparatus 66 and the detection system 64 to perform certain operations.

The detection system 64 further includes an input apparatus 74 that is configured to provide input signals to the processor apparatus 66. Furthermore, the detection system 64 can be said to include an output apparatus 76 that receives output signals from the processor apparatus 66. As a general matter, input signals that are received from the input apparatus 74 are subjected to processing by the routines 72 and, in certain circumstances, result in certain output signals being provided to the output apparatus 76, as will be set forth in greater detail below. The detection system 64 further includes a circuit board 78 that is depicted generally in FIG. 4 as including various circuitry components and has the processor apparatus 66 situated thereon.

The input apparatus 74 can be said to include a reverse loop 80 that is depicted in FIG. 4 as including a current transformer 82 that is situated on the circuit board 78 and as further including a load neutral terminal 83, a reverse conductor 84, and a pigtail 86. In the connected configuration of the interruption apparatus, the load neutral terminal 83 is electrically connectable with the load neutral conductor 10, and the pigtail 86 is electrically connectable with the pigtail neutral conductor 12. The reverse conductor 84 electrically extends between the load neutral terminal 83 and the pigtail 86 and extends through an opening that is formed in the current transformer 82. The conductor 58 likewise extends in an opposite direction through the opening that is formed in the current transformer 82. In a known fashion, the current transformer 82 provides input signals to the processor apparatus 66 to permit the processor apparatus 66 to identify the existence of a ground fault on the circuit with which the interruption apparatus 4 is electrically connected. The detection system 64 can thus be said to include, among its features, a ground fault detection feature.

The detection system 64 of the depicted exemplary embodiment can be said to include other features in the form of additional fault detection capabilities. For example, the routines 72 analyze the input signals that are received from the current transformer 82 and from other signal from the input apparatus 74. The routines 72 are executable on the processor 68 and are operable to detect a branch arc fault, which is a fault that is connected in parallel with the load, and to additionally detect a series arc fault that is a fault is in series with the load. The detection system 64 can thus be said to provide a combination arc fault detection feature in addition to its ground fault detection feature.

It is understood, however, that in other embodiments of the second portion 16 the detection system 64 may be provided without the ground fault detection feature and/or without the branch arc fault detection feature and/or without the series arc fault detection feature without departing from the present concept. That is, the detection system 64 may provide any or omit one or more of a variety of fault detection features such as those that are mentioned herein or other fault detection features in any combination. The second portion 16 can be selected from among a plurality of similar second portions 16 that have different combinations of fault detection features or other features in order to provide to the interruption apparatus 4 specific fault detection features and other features as needed for the specific application in which the interruption apparatus 4 is intended to be used. It is reiterated that in still other embodiments, the second portion 16 may be configured such that its second electrical apparatus includes only the conductor apparatus 56 without additionally including the detection system 64 if no fault detection capabilities are desired for the interruption apparatus 4.

In this regard, the same can be said of the first portion 14 that includes the thermal and magnetic trip 34 and a predetermined current interruption rating. Other embodiments of the first portion 14 can have any of a wide variety of current interruption ratings and, depending upon the needs of the particular application, may omit or modify the thermal and magnetic trip 34. The first portion 14 is selected from among a plurality of first portions 14 having different current interruption ratings and, potentially, omitting or modifying the thermal and magnetic trip 34.

The desired first portion 14 having the desired specifications such as a desired current interruption rating and the like, is then combined with the desired second portion 16 having, if desired, the detection system 64 and, if so, having certain desired fault detection capabilities or other capabilities that are provided by the detection system 64. In this regard, any of the first portions 14 are combinable with any of the second portions 16 to field configure any of a large number of interruption apparatuses 4 having different combinations of specification and features.

Figure 7:
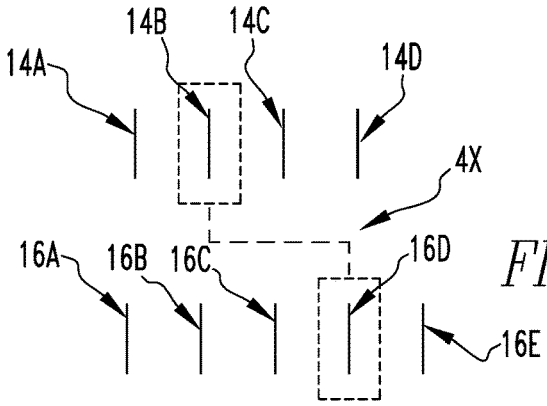
FIG. 7 is a schematic depiction of the interruption apparatus of FIG. 1 having a first portion that is selected from a plurality of first portions having different specifications and further having a second portion that is selected from a plurality of second portions having different specifications.

By way of example, a contractor may desire that the interruption apparatus 4 have a twenty Ampere current interruption rating and to additionally include ground fault detection without additionally providing branch or series arc fault detection. The contractor thus would select, as in FIG. 7, a particular first portion 14B having a twenty Ampere current interruption rating and would additionally select a particular second portion 16D having a ground fault detection capability but without any other fault detection capabilities. The desired first portion 14B and the desired second portion 16D would be combinable to form the desired interruption apparatus 4X. The desired first portion 14B would be selected from among an exemplary plurality of first portions 14, designated as having the numerals 14A, 14B, 14C, and 14D, each of which has a different current interruption rating or having other specifications that may vary from each other. Likewise, the desired second portion 16D would be selected from an exemplary plurality of second portions that are indicated at the numerals 16A, 16B, 16C, 16D, and 16E, and each of which has a second electrical apparatus 52 having different specifications. For example, the second portion 16A might include the conductor apparatus 56 but might omit the detection system 64. The second portion 16B might include the detection system 64 but provide only branch arc fault detection capability. Other variations will be apparent.

The detection system 64 further includes an actuator 87 that includes a plunger 88 and a solenoid 90. The solenoid 90 can be energized by the processor apparatus 66 to cause the plunger 88 to move between a retracted position, such as is depicted generally in FIG. 5, and an extended position, such as is depicted generally in FIG. 6. When the solenoid 90 is in a de-energized stated, the plunger 88 is in the retracted position, such as is depicted generally in FIG. 5. In FIG. 5, the set of separable contacts 30 are in the closed state and the interruption apparatus 4 is in an ON condition. In the retracted position, the plunger 88 protrudes outwardly from the second housing 50 and is received in receptacle 44 (FIG. 1) in proximity to the receiver leg 40 of the connection crank 36.

If the detection system 64 detects a fault, such as a ground fault or an arc fault (depending upon the features provided by the detection system 64), the processor apparatus 66 will provide an output signal to the output apparatus 66 which results in the solenoid 90 being energized and, in turn, causes the plunger 88 to move from the retracted position of FIG. 5 to the extended position of FIG. 6. In the extended position of FIG. 6, the plunger 88 is received a greater distance through the receptacle 44 and into the first interior region 22 where it engages the receiver leg 40 and causes the connection crank 36 to pivot about the support 38. Such pivoting of the connection crank 36 about the support 38 causes the trigger leg 42 to engage the thermal and magnetic trip 34 and pivots the thermal and magnetic trip 34 in a fashion that causes the latch of the trip unit 24 to release its spring-energized mechanism. This causes the contact arm 32 to pivot the movable contact situated thereon away from the stationary contact whereupon the set of separable contacts 30 is moved from the CLOSED state to the OPEN state that is depicted generally in FIG. 6. Upon removal of the fault, the routines 72 cause the processor apparatus 66 to de-energize the solenoid 90, thereby returning the plunger 88 to its retracted position. The first portion 14 can then be reset by resetting the trip unit 24 back to the CLOSED state of the set of separable contacts 30.

The input apparatus 74 additionally includes a TEST button 98 that is situated on a platform 96 of the second housing 50. The platform 96 is received in a socket 95 of the first housing 18 when the first and second portions 14 and 16 are in the connected configuration. The TEST button 98 includes a microswitch that is connected with the processor apparatus 66 and which, when actuated, causes the solenoid 90 to be energized to cause the plunger 88 to move from the retracted position to the extended position to thereby trip the first portion 14. The TEST button 98, being situated on the platform 96, remains exposed when the first and second portions 14 and 16 are in the connected configuration and thus enables the detection system 64 to be tested on a regular basis to ensure its continued operability. While the exemplary platform 96 overlies a portion of the first housing 18 to cause the TEST button 98 to remain exposed in the connected configuration of the first and second portions 14 and 16, it is understood that the TEST button 98 in other embodiments could be mounted elsewhere as long as it remains exposed and actuatable by a user.

The second housing 50 additionally includes a plurality of connection lugs 92 that protrude from a wall of the second housing 50 and which each have an engagement surface 94. The connection lugs 92 are receivable in the openings 45 of the first housing 18 to cause the engagement surfaces 94 to contact and become engaged with the retention surfaces 48. The engagement of the engagement surfaces 94 with the retention surfaces 48 locks the first and second portions 14 and 6 together in the connected configuration from which the first and second portions are irremovable. Stated otherwise, the first and second portions 14 and 16 can be moved from the detached configuration to the connected configuration, but the process cannot be reversed without destruction of the first housing 18 and/or the second housing 50. This advantageously resists the interruption apparatus 4 from being disconnected in a potentially live, i.e., electrified, condition. By causing the engagement surfaces 94 and the retention surfaces 48 to be engaged with one another within the first interior region 22, and by causing the connection lugs 92 to be situated enclosed within the first interior region 22 in the connected configuration, the engagement surfaces 94 and the retention surfaces 48 are advantageously incapable of being disengaged from one another by a person who may be disposed at the exterior of the interruption apparatus 4.

It thus can be seen that in the detached configuration of FIGS. 1 and 3-4, the first and second portions are physically and electrically disconnected from one another. In the connected configuration of FIGS. 5-6, however, the first and second housings 18 and 50 are physically affixed together, and the first and second electrical apparatuses 20 and 52 are electrically connected together. In this regard, it thus can be understood that the first portion 14 is advantageously selected to have a current interruption rating and, perhaps, other specifications depending upon the need of the application for which the interruption apparatus 4 is intended. Likewise, the second portion 16 is selected from a plurality of second portions 16 as having features, such as the conductor apparatus 56 and, possibly, the detection system 64, in order to provide to the resultant interruption apparatus 4 certain fault detection capabilities or an absence of fault detection capabilities, depending upon the needs of the particular application of the interruption apparatus 4. It thus can be seen that by selecting from among a small variety of first portions 14 and a small variety of second portions 16, a contactor or technician can selectively connect together the desired first and second portions 14 and 16 and thus field configure a large variety of interruption apparatuses 4 having specific features and specifications that are suited to the various applications that may be required for a particular job. The number of first portions 14 and second portions 16 that may be carried by a contractor are far fewer than the overall number of combinations of features of interruption apparatuses 4 that can result from the available combinations of the various first and second portions 14 and 16. The interruption apparatus 4 is thus advantageously field configurable to have specific features and specifications that are suited to particular applications in which each such interruption apparatus 4 will be used. Other advantages will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An interruption apparatus structured to be electrically connected with a line conductor and a load conductor of an electrical circuit and to switch at least a portion of the circuit between an ON condition and an OFF condition, the interruption apparatus comprising:

a first portion comprising:

a first housing comprising a number of first walls, a first electrical apparatus situated on the first housing and comprising a set of separable electrical contacts and a first conductor, the first conductor being electrically connected with the set of separable electrical contacts and comprising a first connection element that is structured to be electrically connected with one of the line conductor and the load conductor, and a trip unit situated on the first housing, the trip unit being structured to switch the set of separable electrical contacts between an OPEN state and a CLOSED state;

a second portion comprising:

a second housing comprising a number of second walls, and a second electrical apparatus situated on the second housing and comprising a second conductor, a detection system, and an actuator, the second conductor having a second connection element that is structured to be electrically connected with the other of the line conductor and the load conductor, the detection system being structured to detect at least a first type of fault in the electrical circuit and to generate an output responsive to the detection of the fault;

the first portion and the second portion being movable from a detached configuration to a connected configuration, the first and second portions being physically and electrically disconnected from one another in the detached configuration, the first and second housings being affixed together and the first and second electrical apparatuses being electrically connected together in the connected configuration; and the actuator being movable between a retracted position and an extended position and, responsive to the output, being structured to move from the retracted position to the extended position, the actuator in the extended position being engageable with the trip unit and being structured to initiate switching of the set of separable electrical contacts from the CLOSED state to the OPEN state, the actuator in at least the extended position protruding through a second wall of the number of second walls.

2. The interruption apparatus of claim 1 wherein the second portion is selected from among a plurality of second portions which are each alternatively cooperable with the first portion, the detection system of one second portion of the plurality of second portions being structured to detect a number of types of faults in the electrical circuit and to responsively generate the output, the detection system of another second portion of the plurality of second portions being structured to detect another number of types of faults in the electrical circuit and to responsively generate the output, at least one of the number of types of faults and the another number of types of faults including a type of fault that is absent from the other of the number of types of faults and the another number of types of faults.

3. The interruption apparatus of claim 2 wherein the first portion is selected from a plurality of first portions that are each being alternatively cooperable with the second portion, one first portion of the plurality of first portions having a current interruption rating different than another first portion of the plurality of first portions.

4. The interruption apparatus of claim 1 wherein the actuator in the retracted position protrudes through the second wall.

5. The interruption apparatus of claim 4 wherein a first wall of the number of first walls has a receptacle formed therein, the actuator in the retracted position being received in the receptacle.

6. The interruption apparatus of claim 5 wherein the first wall and the second wall confront one another in the connected configuration.

7. The interruption apparatus of claim 5 wherein the first housing comprises a first interior region, and wherein in the retracted position a first portion of the actuator is received in the first interior region.

8. The interruption apparatus of claim 7 wherein in the extended position a second portion of the actuator greater than the first portion is received in the first interior region.

9. The interruption apparatus of claim 7 wherein the second housing has a second interior region within which the second electrical apparatus is situated, and wherein the actuator in the retracted position is at least partially received in the second interior region.

10. The interruption apparatus of claim 1 wherein the second portion further comprises a TEST input device which, when actuated, is structured to provide a TEST input to the detection system, the detection system being structured to generate the output responsive to the TEST input.

11. An interruption apparatus structured to be electrically connected with a line conductor and a load conductor of an electrical circuit and to switch at least a portion of the circuit between an ON condition and an OFF condition, the interruption apparatus comprising:

a first portion comprising:

a first housing comprising a number of first walls, a first wall of the number of first walls having a receptacle formed therein, a first electrical apparatus situated on the first housing and comprising a set of separable electrical contacts and a first conductor, the first conductor being electrically connected with the set of separable electrical contacts and comprising a first connection element that is structured to be electrically connected with one of the line conductor and the load conductor, and a trip unit situated on the first housing, the trip unit being structured to switch the set of separable electrical contacts between an OPEN state and a CLOSED state;

a second portion comprising:

a second housing comprising a number of second walls, and a second electrical apparatus situated on the second housing and comprising a second conductor, a detection system, and an actuator, the second conductor having a second connection element that is structured to be electrically connected with the other of the line conductor and the load conductor, the detection system being structured to detect at least a first type of fault in the electrical circuit and to generate an output responsive to the detection of the fault;

the first portion and the second portion being movable from a detached configuration to a connected configuration, the first and second portions being physically and electrically disconnected from one another in the detached configuration, the first and second housings being affixed together and the first and second electrical apparatuses being electrically connected together in the connected configuration; and the actuator being movable between a retracted position and an extended position and, responsive to the output, being structured to move from the retracted position to the extended position, the actuator in the extended position being received in the receptacle and being engageable with the trip unit and being structured to initiate switching of the set of separable electrical contacts from the CLOSED state to the OPEN state.

12. The interruption apparatus of claim 11 wherein the second portion is selected from among a plurality of second portions which are each alternatively cooperable with the first portion, the detection system of one second portion of the plurality of second portions being structured to detect a number of types of faults in the electrical circuit and to responsively generate the output, the detection system of another second portion of the plurality of second portions being structured to detect another number of types of faults in the electrical circuit and to responsively generate the output, at least one of the number of types of faults and the another number of types of faults including a type of fault that is absent from the other of the number of types of faults and the another number of types of faults.

13. The interruption apparatus of claim 12 wherein the first portion is selected from a plurality of first portions that are each being alternatively cooperable with the second portion, one first portion of the plurality of first portions having a current interruption rating different than another first portion of the plurality of first portions.

14. The interruption apparatus of claim 11 wherein the actuator in at least the extended position protrudes through a second wall of the number of second walls.

15. The interruption apparatus of claim 14 wherein the actuator in the retracted position is received in the receptacle.

16. The interruption apparatus of claim 15 wherein the first wall and the second wall confront one another in the connected configuration.

17. The interruption apparatus of claim 15 wherein the first housing comprises a first interior region, and wherein in the retracted position a first portion of the actuator is received in the first interior region.

18. The interruption apparatus of claim 17 wherein in the extended position a second portion of the actuator greater than the first portion is received in the first interior region.

19. The interruption apparatus of claim 17 wherein the second housing has a second interior region within which the second electrical apparatus is situated, and wherein the actuator in the retracted position is at least partially received in the second interior region.

20. The interruption apparatus of claim 11 wherein the second portion further comprises a TEST input device which, when actuated, is structured to provide a TEST input to the detection system, the detection system being structured to generate the output responsive to the TEST input.

* * * * *